US008317300B2

(12) United States Patent
Murray

(10) Patent No.: US 8,317,300 B2
(45) Date of Patent: Nov. 27, 2012

(54) INKJET PRINTER

(75) Inventor: Richard A. Murray, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 339 days.

(21) Appl. No.: 12/750,738

(22) Filed: Mar. 31, 2010

(65) Prior Publication Data

US 2011/0242231 A1 Oct. 6, 2011

(51) Int. Cl.
*B41J 2/14* (2006.01)

(52) U.S. Cl. ..... 347/49

(58) Field of Classification Search ..... 347/49, 347/85, 86, 87
See application file for complete search history.

(56) References Cited

U.S. PATENT DOCUMENTS

| | | | | |
|---|---|---|---|---|
| 5,534,899 | A | 7/1996 | Uchikata et al. | |
| 5,706,040 | A | 1/1998 | Reid et al. | |
| 5,847,731 | A | 12/1998 | Kashimura et al. | |
| 5,975,688 | A * | 11/1999 | Kanaya et al. | 347/86 |
| 6,202,454 | B1 | 3/2001 | Nakasuji | |
| 6,250,750 | B1 * | 6/2001 | Miyazawa et al. | 347/87 |
| 6,481,829 | B1 * | 11/2002 | Bailey et al. | 347/49 |
| 6,499,826 | B1 | 12/2002 | Kline et al. | |
| 6,979,079 | B2 * | 12/2005 | Hashii et al. | 347/86 |
| 7,384,124 | B2 * | 6/2008 | Yang | 347/37 |
| 2004/0183856 | A1 | 9/2004 | Yang | |
| 2005/0285900 | A1 | 12/2005 | Benson et al. | |
| 2007/0211131 | A1 | 9/2007 | Iijima | |
| 2009/0195364 | A1 | 8/2009 | Edwards et al. | |
| 2010/0085404 | A1 | 4/2010 | Akiyama | |
| 2010/0245456 | A1 | 9/2010 | Nakamura | |

FOREIGN PATENT DOCUMENTS

| | | | |
|---|---|---|---|
| EP | 0 903 236 | A2 | 3/1999 |
| EP | 1 078 769 | A2 | 2/2001 |
| GB | 2 323 817 | A | 10/1998 |
| WO | WO 01/49499 | A1 | 7/2001 |

* cited by examiner

*Primary Examiner* — Anh T. N. Vo
(74) *Attorney, Agent, or Firm* — Peyton C. Watkins

(57) ABSTRACT

An inkjet printer includes a carriage guide including a carriage guide direction; an inkjet nozzle array that is movable back and forth along the carriage guide direction; an ink tank for providing ink to the inkjet nozzle array; and a holding receptacle for the ink tank, the holding receptacle includes a base surface for supporting the ink supply, the base surface including a first end and a second end that is opposite the first end; a latch including a latching member proximate the first end of the base surface for retaining the ink tank in the holding receptacle; and a wall that includes an ink inlet port configured to receive ink from the ink tank, wherein the wall is proximate the second end of the base surface.

21 Claims, 22 Drawing Sheets

INKJET PRINTER

CROSS REFERENCE TO RELATED APPLICATIONS

Reference is made to commonly assigned U.S. patent application Ser. No. 12/750,732 filed Mar. 31, 2010 by Richard Murray, entitled "INKJET INK TANK", and commonly assigned U.S. patent application Ser. No. 12/750,729 filed Mar. 31, 2010 by Richard Murray, entitled "HOLDING RECEPTACLE FOR INKJET INK TANK", the disclosures of which are herein incorporated by reference.

FIELD OF THE INVENTION

The present invention relates generally to a holding receptacle for at least one ink tank in an inkjet printer, and more particularly to a holding receptacle that facilitates horizontal installation of an ink tank in the printer.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed, and the image is formed swath by swath.

The ink supply on a carriage printer can be mounted on the carriage or off the carriage. For the case of ink supplies being mounted on the carriage, the ink tank can be permanently integrated with the printhead as a print cartridge so that the printhead needs to be replaced when the ink is depleted, or the ink tank can be detachably mounted to a holding receptacle in the printhead so that only the ink tank itself needs to be replaced when the ink tank is depleted. Carriage mounted ink tanks typically contain only enough ink for up to about several hundred prints. This is because the total mass of the carriage needs to be limited so that accelerations of the carriage at each end of the travel do not result in large forces that can shake the printer back and forth. As a result, users of carriage printers need to replace carriage-mounted ink tanks periodically depending on their printing usage, typically several times per year. Consequently, the task of replacing a detachably mounted ink tank in the holding receptacle should be simple and reliable.

In addition, it is desired to reduce the size of the inkjet printer. Smaller printer size is helpful to the user for fitting the printer in available workspace. In some cases, a user will locate the printer on a shelf rather than on a desktop in order to provide more working space on the desktop. In such cases, it is particularly advantageous to reduce the height and depth of the printer. Especially for a printer located on an elevated shelf it is also desirable to install ink tanks from the front of the printer in horizontal fashion, rather than opening a clamshell printer lid and installing the ink tanks from the top of the printer. Compact printer size is also consistent with lower cost of manufacturing and shipping the printer.

What is needed is a holding receptacle that facilitates easy installation of one or more ink tanks from the front of a printer (especially a compact-sized printer) and securely latches the ink tank(s) in place.

SUMMARY OF THE INVENTION

The present invention is directed to overcoming one or more of the problems set forth above. Briefly summarized, according to one aspect of the invention, the invention resides in a holding receptacle for at least one ink tank in an inkjet printer, the holding receptacle comprising (a) a base surface for supporting the ink supply, the base surface including a first end and a second end that is opposite the first end; (b) a latch proximate the first end of the base surface for retaining the ink tank in the holding receptacle; and (c) a wall that includes an ink inlet port configured to receive ink from the ink tank, wherein the wall is proximate the second end of the base surface.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
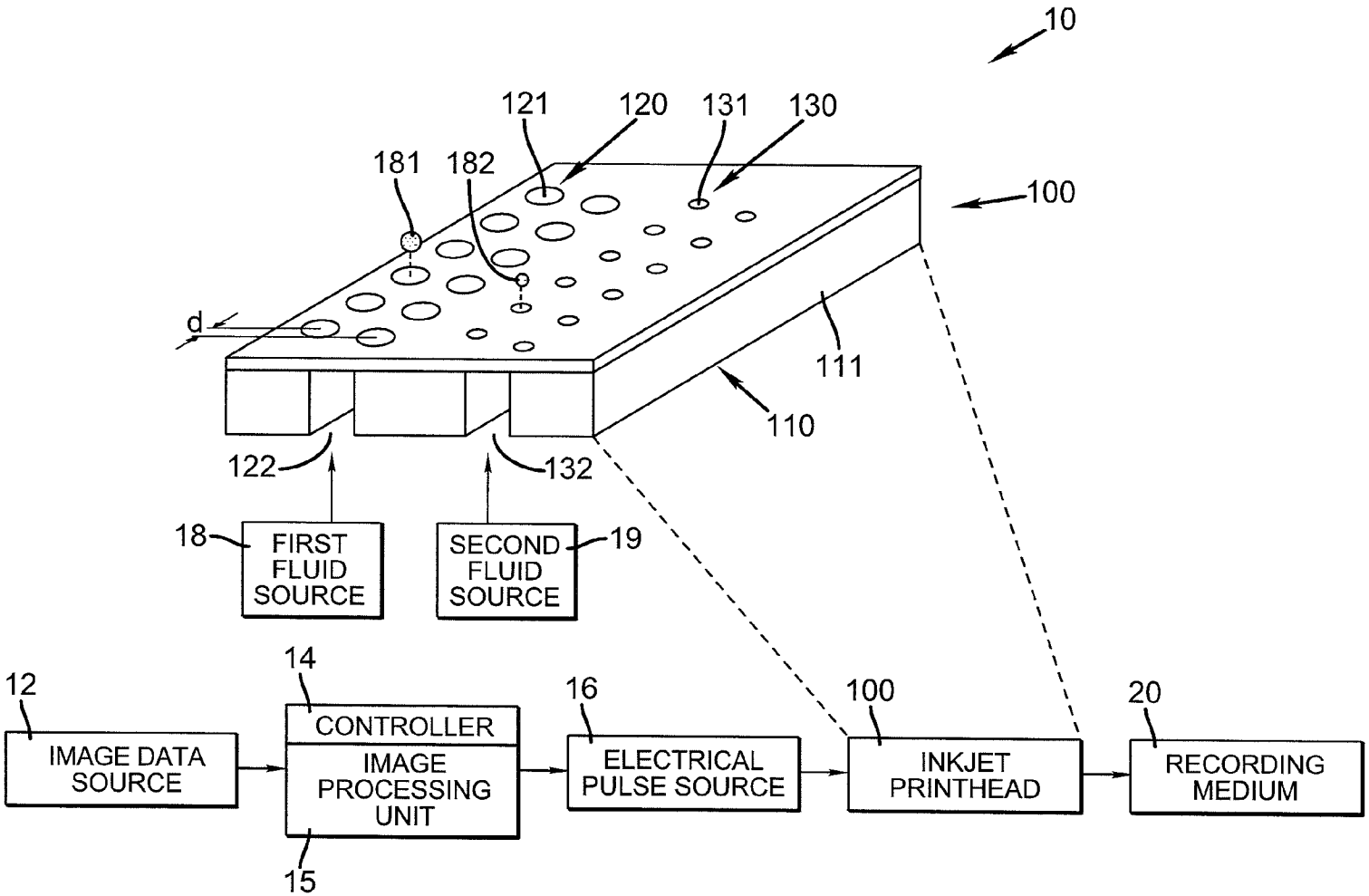
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. Each nozzle array is supplied by a fluid source. In some embodiments, all nozzles on inkjet printhead die 110 can be the same size, rather than having multiple sized nozzles on inkjet printhead die 110.

The drop forming mechanisms associated with the nozzles are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
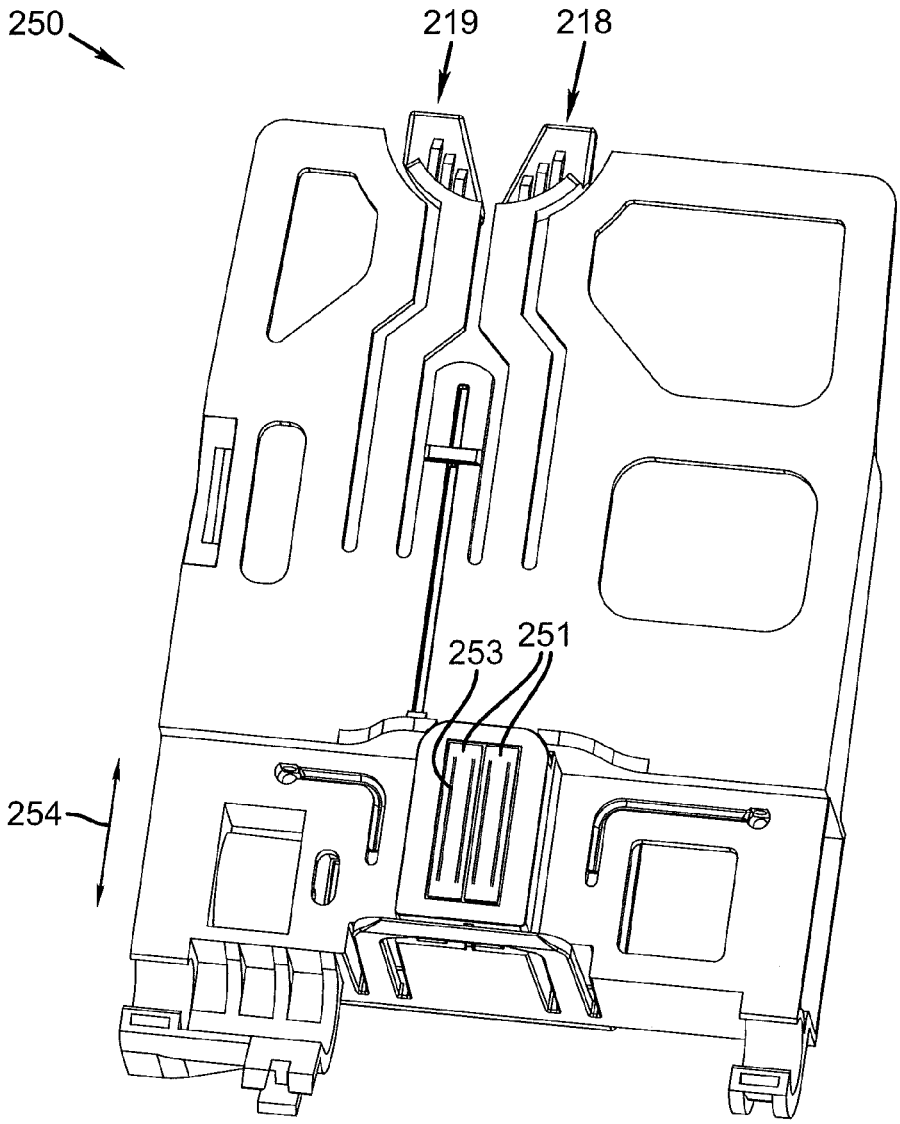
FIG. 2 is a bottom perspective view of a printhead frame.

FIG. 2 shows a bottom perspective view of a printhead frame 250, which is an example of an inkjet printhead 100. Printhead frame 250 includes two printhead die 251 (similar to printhead die 110 in FIG. 1), each printhead die 251 containing two nozzle arrays 253, so that printhead frame 250 contains four nozzle arrays 253 altogether. The four nozzle arrays 253 in this example can each be connected to separate ink sources (not shown in FIG. 2); such as cyan, magenta, yellow, and black. Each of the four nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead frame 250 across the recording medium 20. Following the printing of a swath, the recording medium 20 is advanced along a media advance direction that is substantially parallel to nozzle array direction 254.

Figure 3:
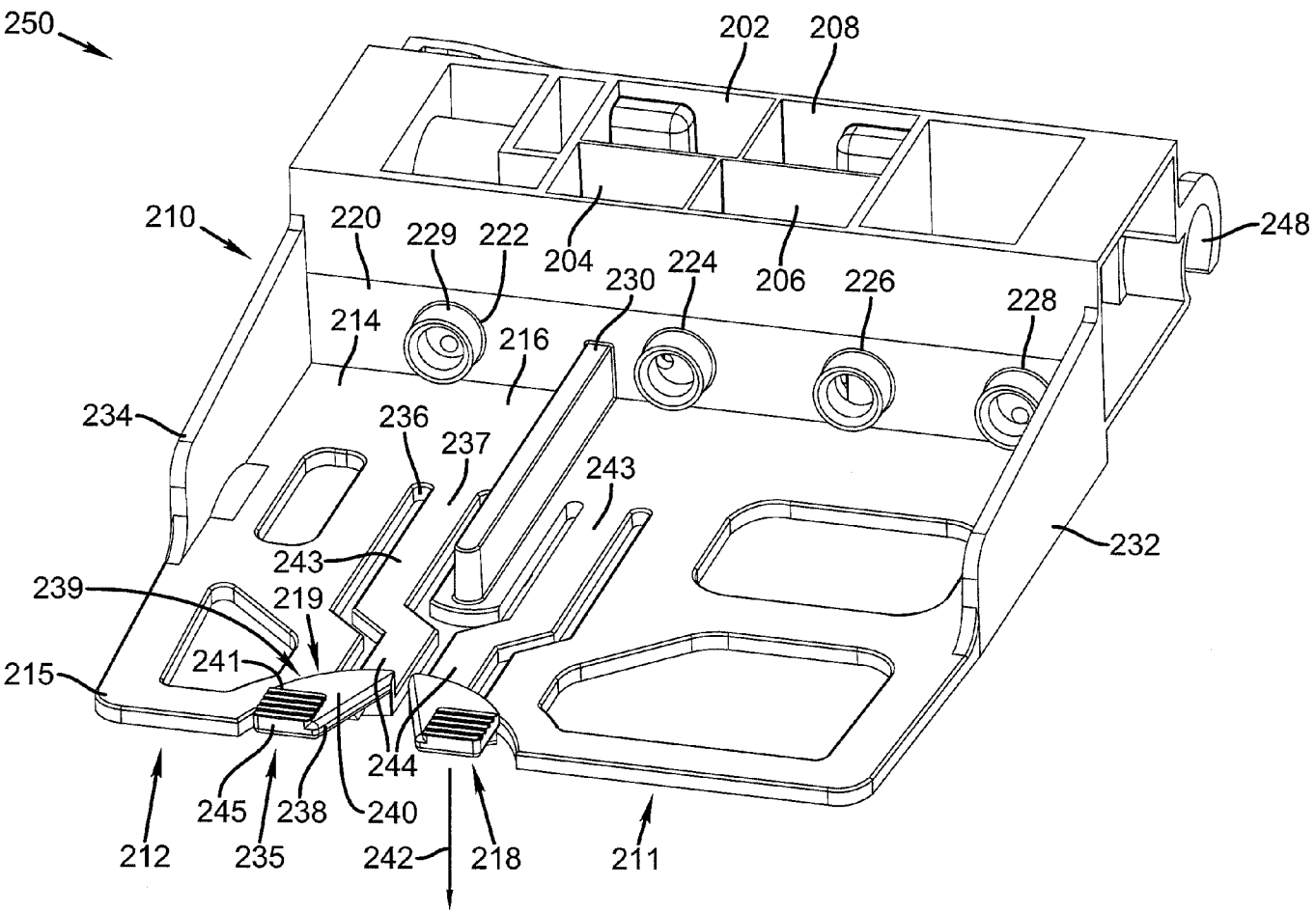
FIG. 3 is a front perspective view of a printhead frame including a holding receptacle according to an embodiment of the invention.
Figure 4:
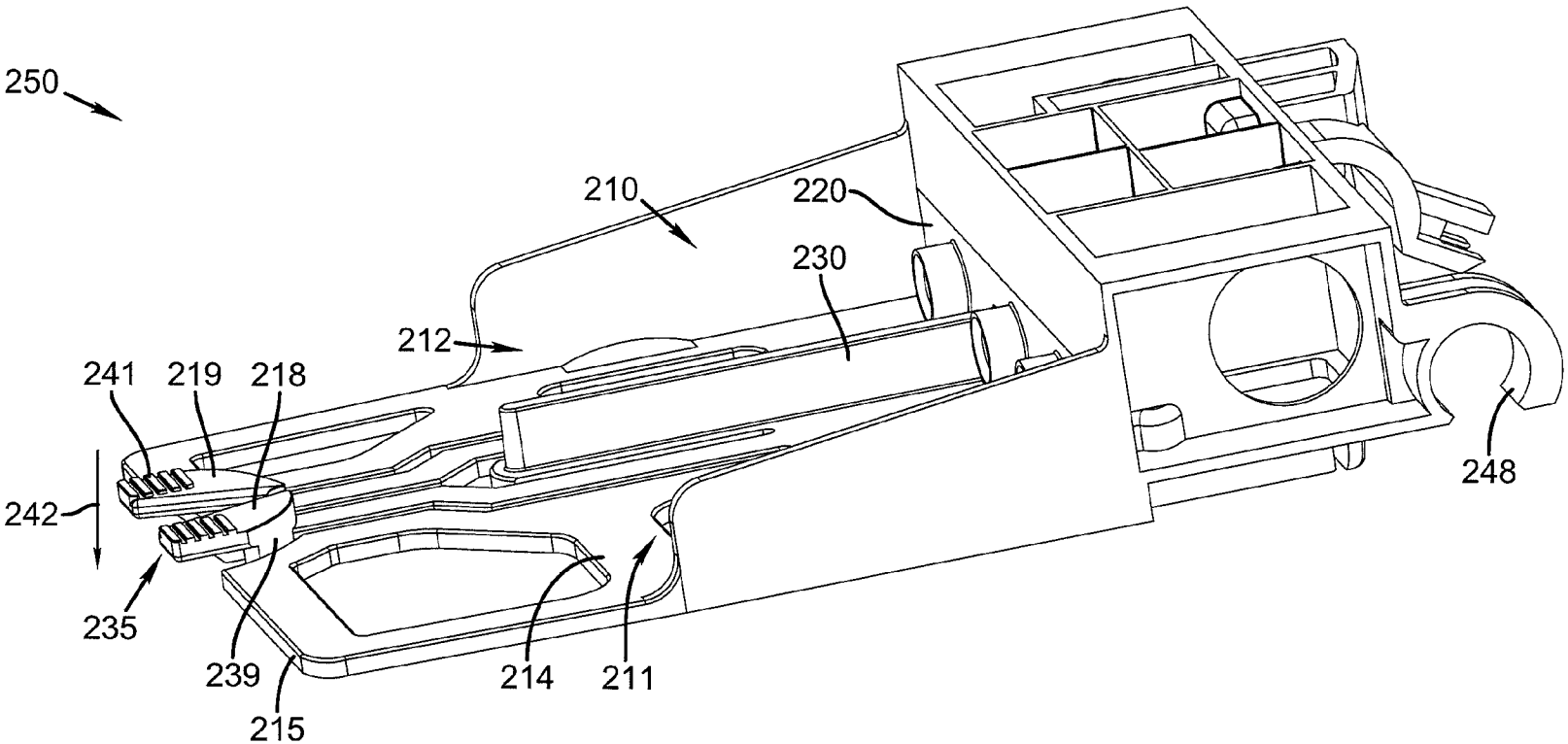
FIG. 4 is a side perspective view of the printhead frame of FIG. 3.
Figure 5:
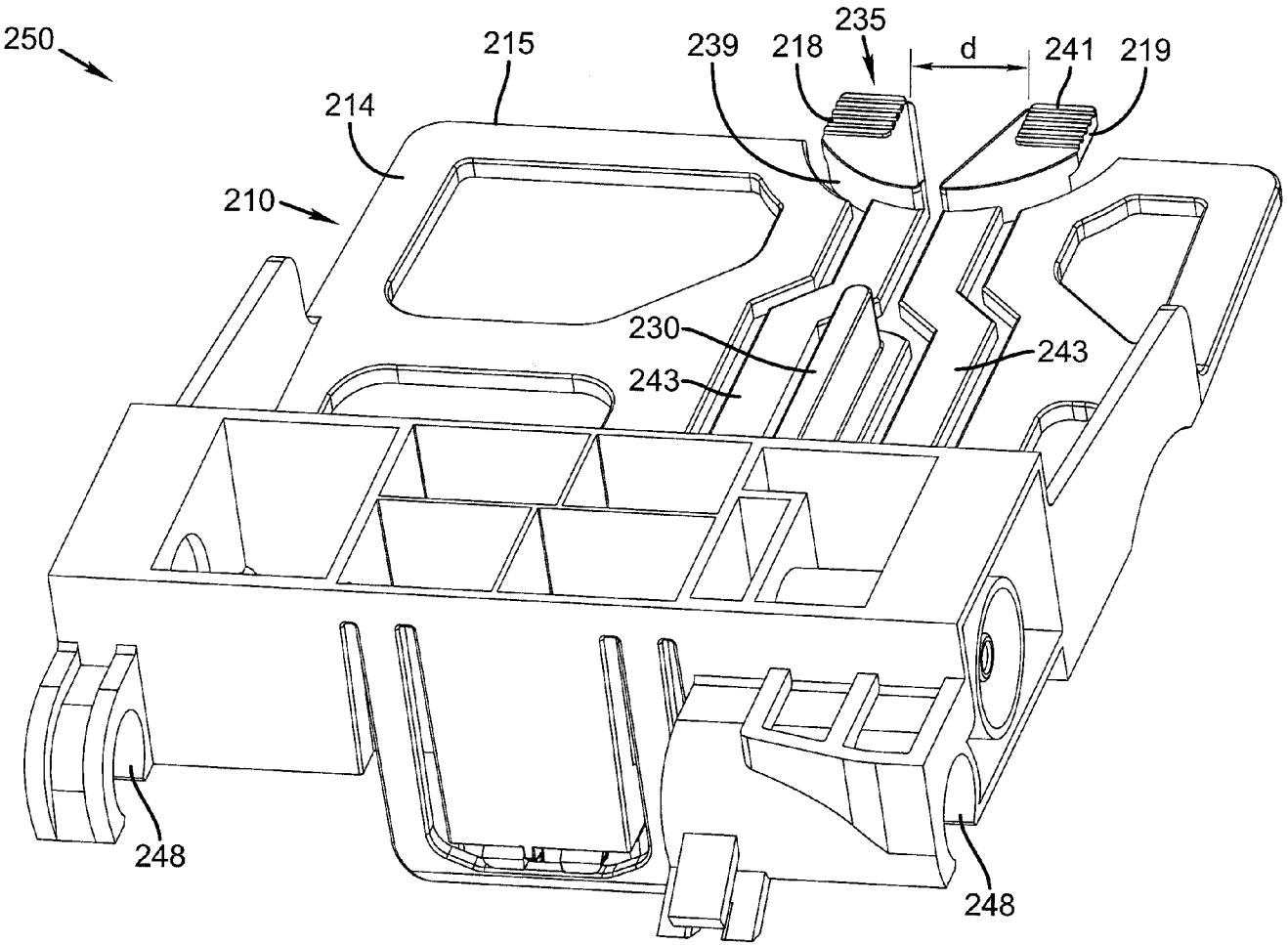
FIG. 5 is a rear perspective view of the printhead frame of FIG. 3.
Figure 6:
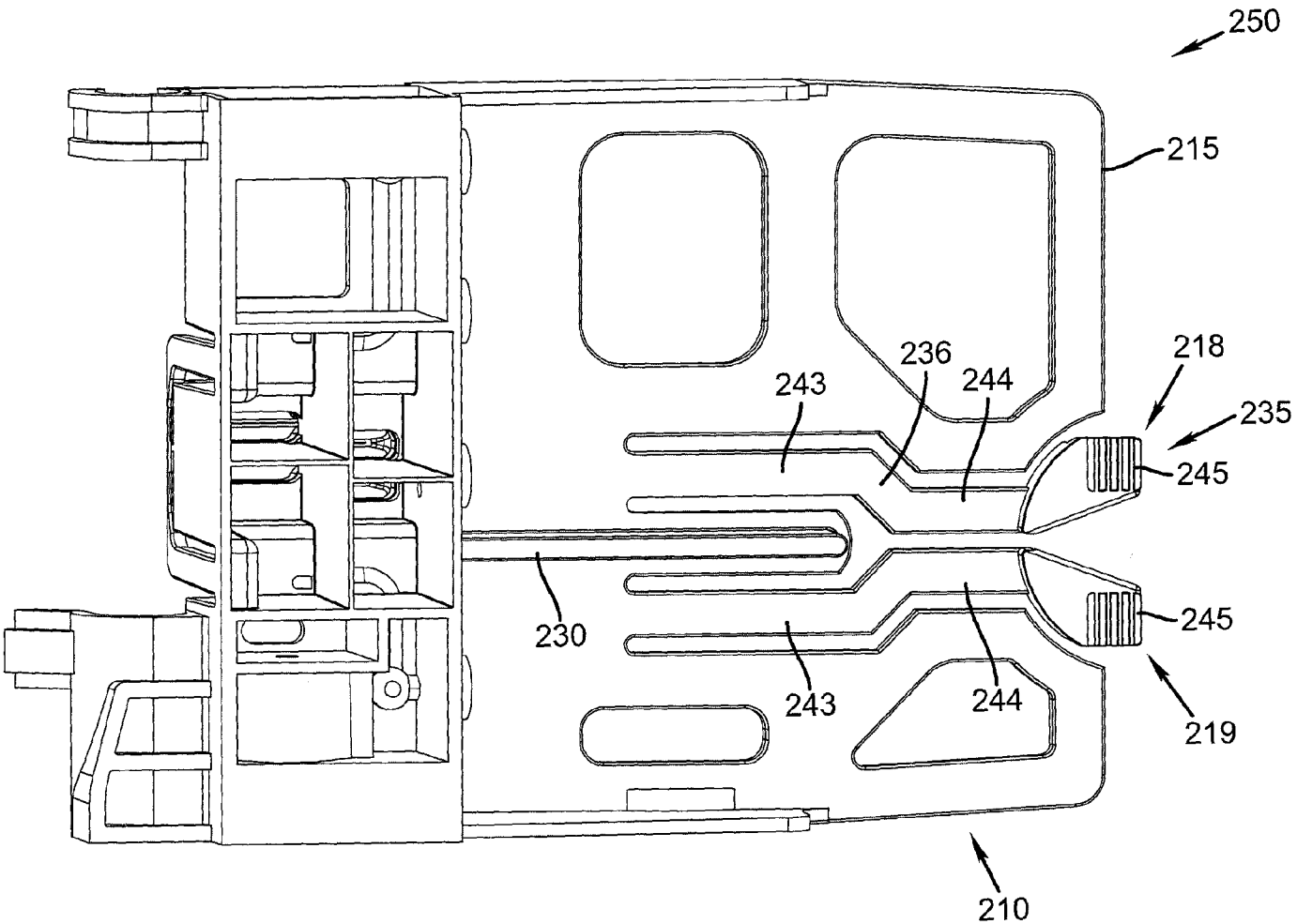
FIG. 6 is a top perspective view of the printhead frame of FIG. 3.

FIG. 3 shows a front perspective view of a printhead frame 250 including holding receptacle 210 for ink tanks (not shown in FIG. 3) according to an embodiment of the invention. Similarly, FIGS. 4-6 show side perspective, rear perspective and top perspective views of the printhead frame 250 of FIG. 3. Holding receptacle 210 includes a first part 211 for holding a multichamber ink tank and a second part 212 for holding a single chamber ink tank. Holding receptacle 210 has a base surface 214 for supporting the ink tanks. Base surface 214 has a first end 215 and a second end 216 that is opposite first end 215. Latch 218 is located near the first end 215 of the base surface 214 of first part 211 of holding receptacle 210, and latch 219 is located near the first end 215 of the base surface 214 of second part 212 of holding receptacle 210 for retaining the respective ink tanks. Wall 220 is located near the second end 216 of base surface 214 and adjoins base surface 214. Wall 220 includes ink inlet ports 224, 226 and 228 corresponding to first part 211 of holding receptacle 210, and also includes ink inlet port 222 corresponding to second part 212 of holding receptacle 210. Ink inlet ports 222, 224, 226 and 228 are connected to ink chambers 202, 204, 206 and 208, which are arranged in two rows, as is described in more detail in commonly assigned U.S. patent application Ser. No. 12/750,752. The ink inlet ports are configured to receive ink from respective ink tanks (not shown in FIG. 3). The ink inlet ports 222, 224, 226 and 228 include pipes 229 that extend from wall 220 toward the first end 215 of base surface 214 in order to fluidly connect to corresponding ink outlet ports on the ink tanks.

Partition 230 adjoins both base surface 214 and wall 220, and is located between a portion of first part 211 and a portion of second part 212 of holding receptacle 210. First sidewall 232 of holding receptacle 210 also adjoins both base surface 214 and wall 220. Second sidewall 234 of holding receptacle 210 is opposite first sidewall 232 and is substantially parallel to it. Partition 230 is located between first sidewall 232 and second sidewall 234. Partition 230 adjoins wall 220 between ink inlet port 222 and ink inlet port 224. In order to spread out ink inlet ports 224, 226 and 228 within first part 211 of holding receptacle 210, ink inlet port 224 is located close to partition 230 and ink inlet port 228 is located close to first sidewall 232. Ink inlet port 222 is more centrally located within second part 212 of holding receptacle 210. As a result, ink inlet port 224 is located closer to partition 230 than ink inlet port 222 is.

In the embodiment shown in FIGS. 2-6, latches 218 and 219 are preferably cantilevered latches that extend from base surface 214. Latches 218 and 219 each contain a free end 235 near the first end 215 of base surface 214. Latches 218 and 219, base surface 214, and other elements of printhead frame 250 can be integrally formed together, for example by injection molding. Cantilevered latches 218 and 219 include a cantilevered arm 236 and a latching member 238 (see FIG. 3) that is located near free end 235. Cantilevered arm 236 includes a surface 237 that is coplanar or substantially coplanar with base surface 214. Latching member 238 includes a latching surface 239 (se FIGS. 3-5) that is substantially perpendicular to the base surface 214. In the embodiment shown in FIGS. 2-6, latching surface 239 is preferably curved. Latching member 238 also includes a pressing member 240 that extends from the latching surface 239 toward the free end 235 of the cantilevered latches 218 and 219. Pressing member 240 includes a pressing surface 241 that is substantially parallel to base surface 214. As shown in FIG. 3, pressing surface 241 can be textured. In the normal position shown most clearly in FIGS. 3-5, the pressing surface 241 is located at a first position, corresponding to a latching position, which is above base surface 214. If pressing member 240 of cantilevered latch 218 or 219 is depressed along pressing direction 242, pressing surface 241 can be relocated to a second position, corresponding to an unlatching position, which is below base surface 214.

The cantilevered arms 236 of latches 218 and 219 include a first portion 243 located near partition 230, such that the first portion 243 of latch 218 is disposed adjacent a first side of partition 230, and the first portion 243 of latch 219 is disposed adjacent a second side of partition 230, where the second side is opposite the first side. Cantilevered arms 236 of latches 218 and 219 extend past partition 230, such that second portion 244 of cantilevered latch 218 is adjacent second portion 244 of cantilevered latch 219. Latching member 238 of cantilevered latch 218 is located near latching member 238 of cantilevered latch 219. In order to facilitate pressing the pressing member 240 of latches 218 and 219 independently of each other, latching member 238 of latch 218 is angled away from latching member 238 of latch 219 near their free ends 235. It is preferable that tip end 245 of the latching member 238 of latch 218 be a distance d (see FIG. 5) of at least 3 mm away from tip end 245 of the latching member 238 of latch 219. In addition, in some embodiments, the free ends 235 of cantilevered latches 218 and 219 extend past first end 215 of base surface 214 of holding receptacle 210.

In some embodiments for a carriage printer, printhead frame 250 also has at least one bearing surface 248 integrally formed together with holding receptacle 210. Bearing surface 248 is intended to ride on a carriage guide in the carriage printer, so that printhead frame 250 also serves as the carriage. In fact, all of the labeled features in FIG. 3 can be integrally formed, for example, in a single injection molding step. This decreases the cost of forming and assembling the printhead and carriage while retaining the required functionality. It can also make the design more compact.

Figure 7:
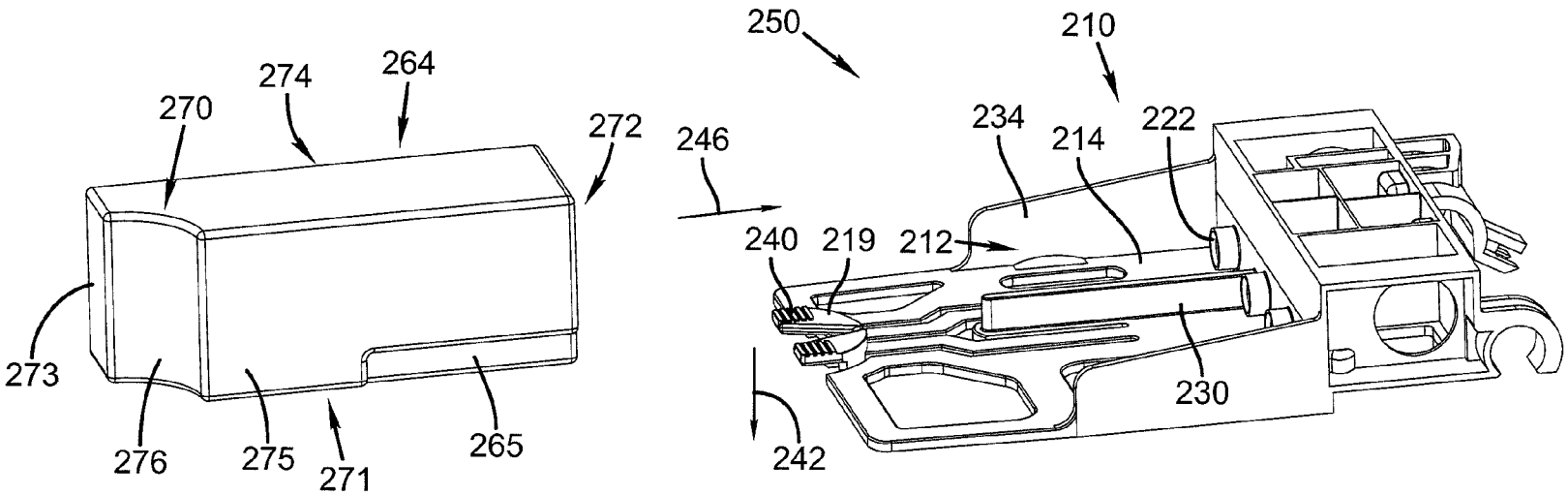
FIG. 7 is a perspective side view of an ink tank in an orientation for loading into a holding receptacle of the printhead frame of FIG. 3.
Figure 8:
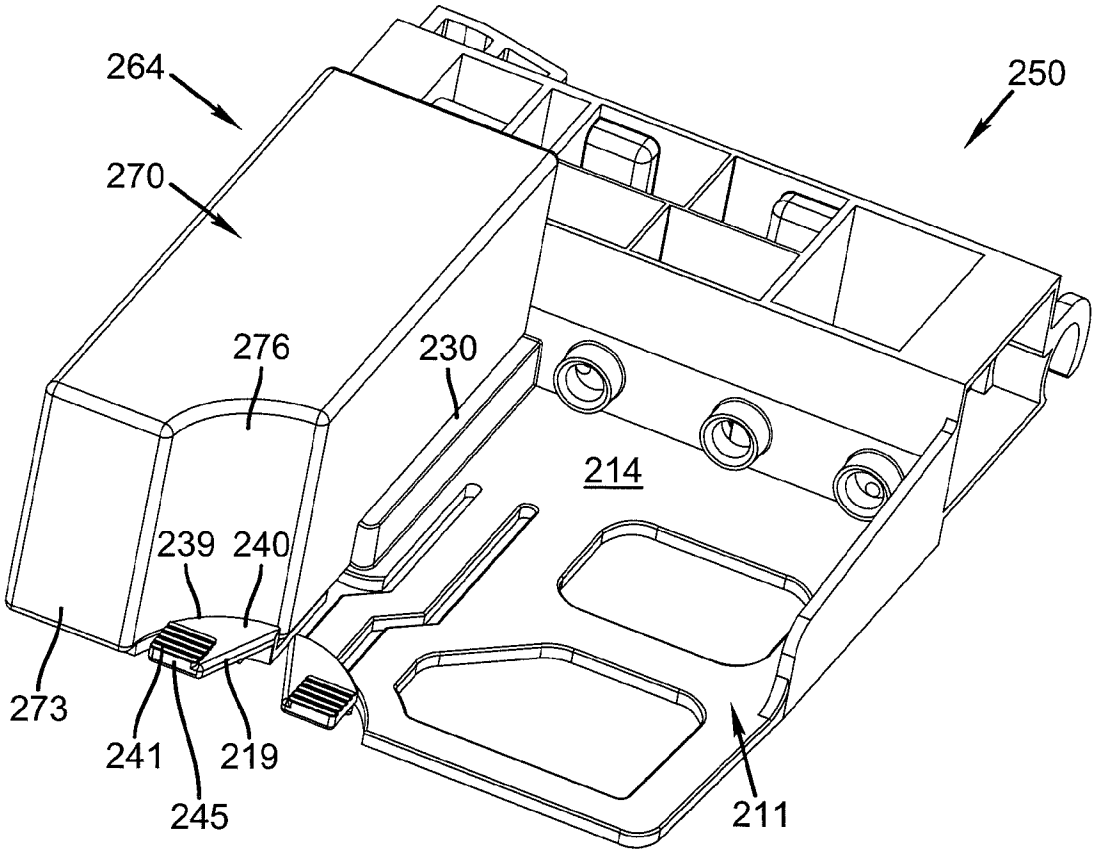
FIG. 8 is a perspective view of the ink tank of FIG. 7 installed and latched into a holding receptacle of the printhead frame FIG. 3.

FIG. 7 shows a perspective side view of a single chamber ink tank 264 in an orientation for loading into second part 212 of holding receptacle 210 of printhead frame 250. Single chamber ink tank 264 is described in more detail below. It consists of an ink chamber (not shown) within the interior of body 270, which includes a bottom wall 271, a first end wall 272 including an ink outlet port (not shown in FIG. 7), a second end wall 273 opposite first end wall 272, a first sidewall 274 that extends a first length from the first end wall 272 to the second end wall 273, a second sidewall 275 that extends a second length (less than the first length) from the first end wall 272, and a connecting wall 276 that forms a recess and that connects the second end wall 273 and the second sidewall 275. In this embodiment, connecting wall 276 is arcuate-shaped and curves inward toward the interior of body 270 in order to form the recess. The first end wall 272, second end wall 273, first sidewall 274 and second sidewall 275 are flat or substantially flat. Optionally, rather than being arcuate-shaped, connecting wall 276 can include a plurality of flat or substantially flat walls (not shown) to provide the recess. Second sidewall 275 extends from first end wall 272 at an angle that is less than obtuse. More preferably, both first sidewall 274 and second sidewall 275 are perpendicular (or substantially perpendicular) to first end wall 272 in order to facilitate inserting single chamber ink tank 264 along insertion direction 246 into second part 212 of holding receptacle 210. As single chamber ink tank 264 is being inserted, first sidewall 274 of the ink tank moves along second sidewall 234 of holding receptacle 210, and indented region 265 of single chamber ink tank 264 moves along partition 230 to guide the insertion so that ink inlet port 222 will engage an ink outlet port (not shown) at the first end wall 272 of the ink tank. Connecting wall 276 is curved inward to accommodate a finger or thumb so that the user can grasp single chamber ink tank 264 between connecting wall 276 and first sidewall 274. Because of the recess provided by connecting wall 276, latch 219 begins to extend beyond connecting wall 276 as the ink tank is being inserted. The user can use the finger or thumb grasping connecting wall 276 to depress latch 219 in pressing direction 242 as the ink tank continues to be inserted. Latching surface 239 of latching member 238 of latch 219 (see also FIGS. 3-5, 8) is curved to fit against the recessed surface of connecting wall 276. When single chamber ink tank 264 is completely inserted, as in FIG. 8, the user can release latch 219 so that pressing surface 241 of pressing member 240 is at its normal latching position above base surface 214. Latching surface 239 of latch 219 thus engages connecting wall 276 of single chamber ink tank 264 to hold it in place in holding receptacle 210. In order to facilitate the user grasping the ink tank, an exterior surface of at least a portion of connecting wall 276 can be textured with a ribbed surface, for example (not shown). To facilitate a compact design, in some embodiments tip end 245 of latch 219 does not extend past second end wall 273 of single chamber ink tank 264 when the ink tank is installed and the latching member 238 engages connecting wall 276. Alternatively in other embodiments, tip end 245 of latch 219 extends past second end wall 273 when the ink tank is installed, but it extends past by less than 3 mm. In FIG. 8, no multichamber ink tank is present in first part 211 of holding receptacle 210.

Figure 9:
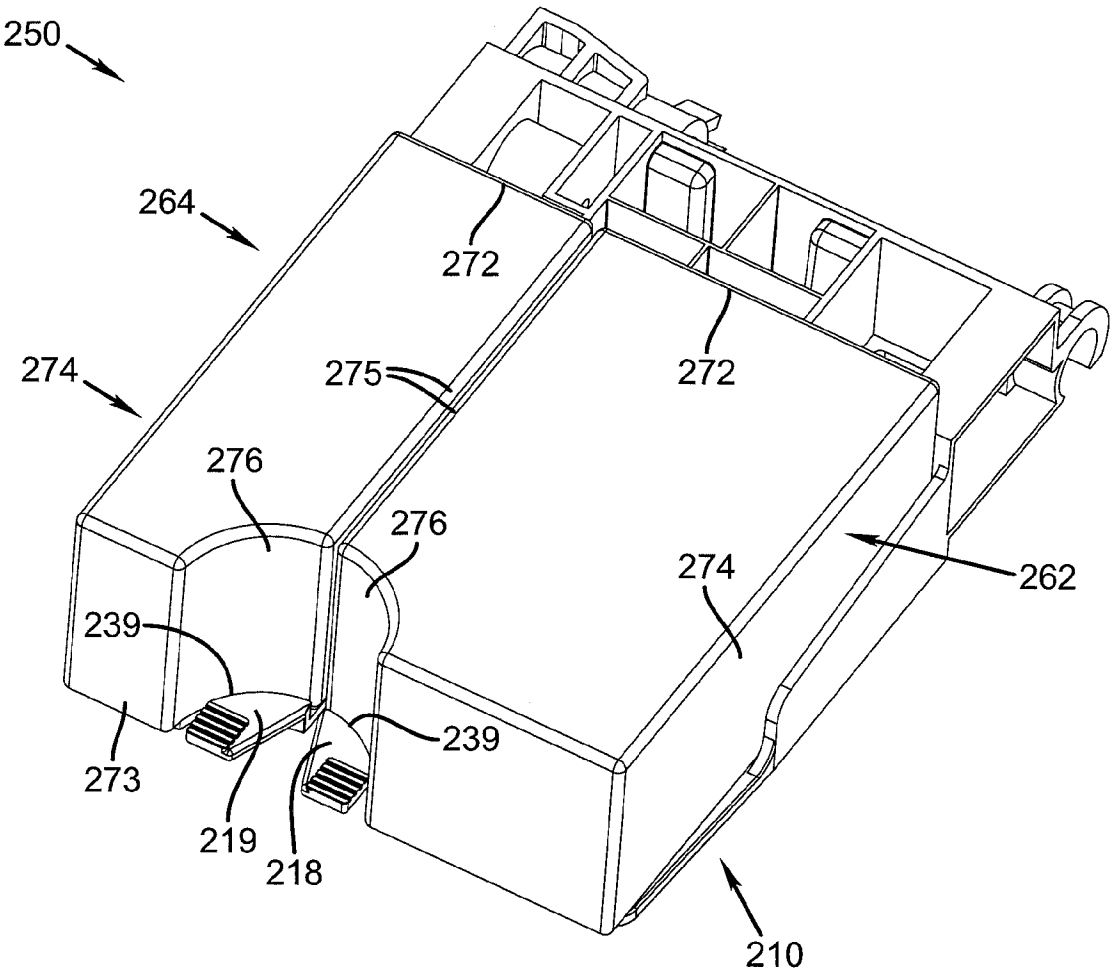
FIG. 9 is a perspective view similar to FIG. 8, but with two ink tanks installed and latched into the holding receptacle.

FIG. 9 shows the same view as FIG. 8, but with both the multi-chamber ink tank 262 and the single chamber ink tank 264 inserted and latched into holding receptacle 210. Latching surface 238 of latch 218 holds connecting wall 276 of multichamber ink tank 262, and latching surface 238 of latch 219 holds connecting wall 276 of single chamber ink tank 264. The features and insertion method described above relative to single chamber ink tank 264 are similar for multichamber ink tank 262 and will not be repeated herein. When the single chamber ink tank 264 is placed next to the multichamber ink tank 262 such that the second sidewall 275 of the single chamber ink tank 264 is adjacent the second sidewall 275 of the multichamber ink tank 262 (as in FIG. 9), then the first end walls 272 of both ink tanks face the same direction. Thus the ink outlet ports (not shown) on end walls 272 of the ink tanks face end wall 220 (see FIG. 3) and the ink inlet ports 222, 224, 226 and 228. Similarly, when the single chamber ink tank 264 is placed next to the multichamber ink tank 262 such that the first end walls 272 of the two ink tanks are aligned with each other (as in FIG. 9), then the connecting wall 276 of the single chamber ink tank 264 is adjacent the connecting wall 276 of the multichamber ink tank 262. Because the connecting walls 276 are curved toward the interior of the respective ink tanks 262 and 264, thus providing recesses, the adjacent recessed connecting walls 276 provide additional room for the user's finger or thumb to latch or unlatch latches 218 and 219 independently. By making the connecting wall 276 of single chamber ink tank 264 mirror-symmetric relative to connecting wall 276 of multichamber ink tank 262, the two ink tanks 262 and 264 making up the ink supply system have a pleasing appearance in addition to contributing to the ease of replacing ink tanks. Similarly, the first length of the first sidewall 274 of single chamber ink tank 264 is substantially equal to the first length of the first sidewall 274 of multichamber ink tank 262, and the second length of the second sidewall 275 of single chamber ink tank 264 is substantially equal to the second length of the second sidewall 275 of multichamber ink tank 262. In addition, the ink supply system of the two tanks 262 and 264 are volume efficient, simple and sleek in form. The recessed connecting walls 276 do not impact the ink holding volume of ink tanks 262 and 264 very much, as the ink chambers (not shown) on the interior of the ink tank body 270 can extend to the interior side of connecting wall 276 and second end wall 273. Rather than having an additional handle or latch on the ink tank body 270, the "handle" is simply first sidewall 274 and connecting wall 276. By eliminating an additional handle or latch from the replaceable ink tanks 262 and 264, the ink tanks are less expensive to make, are more compact and have a more streamlined appearance. Such an ink tank design also allows for a smaller printing envelope and a smaller printer.

Figure 10:
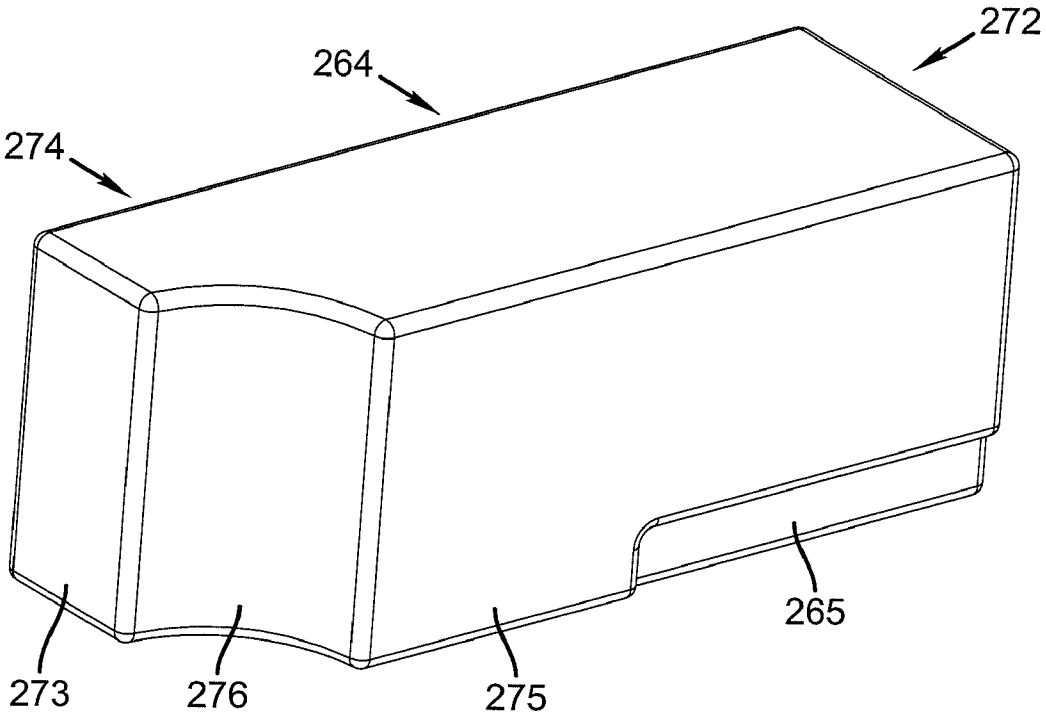
FIGS. 10-13 are perspective views of a single chamber ink tank according to an embodiment of the invention.
Figure 11:
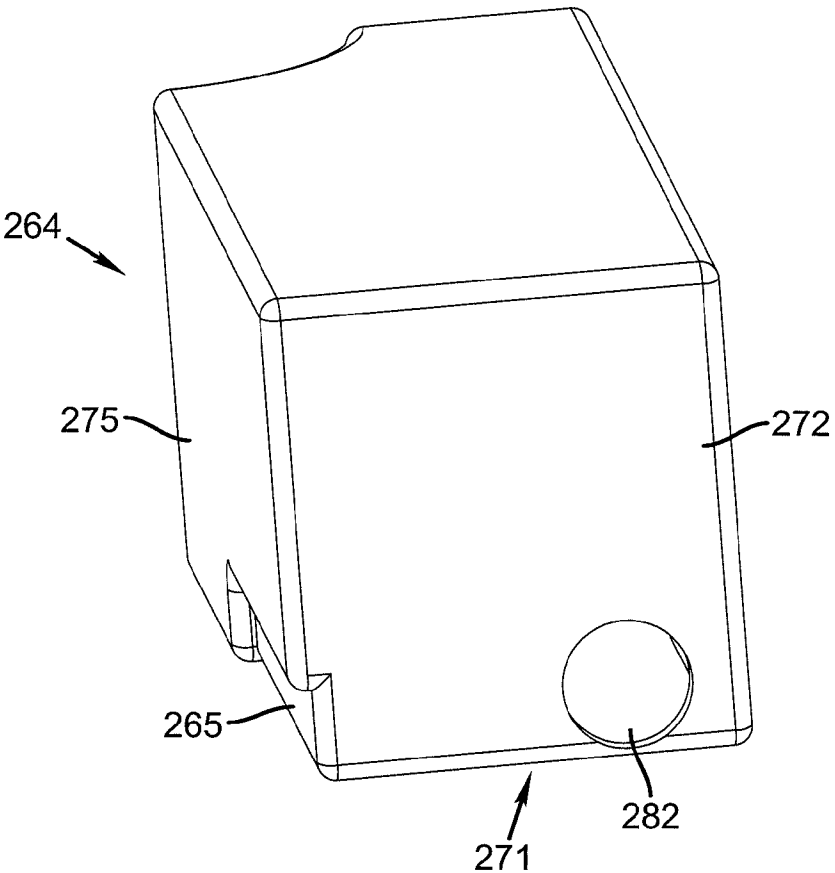
Figure 12:
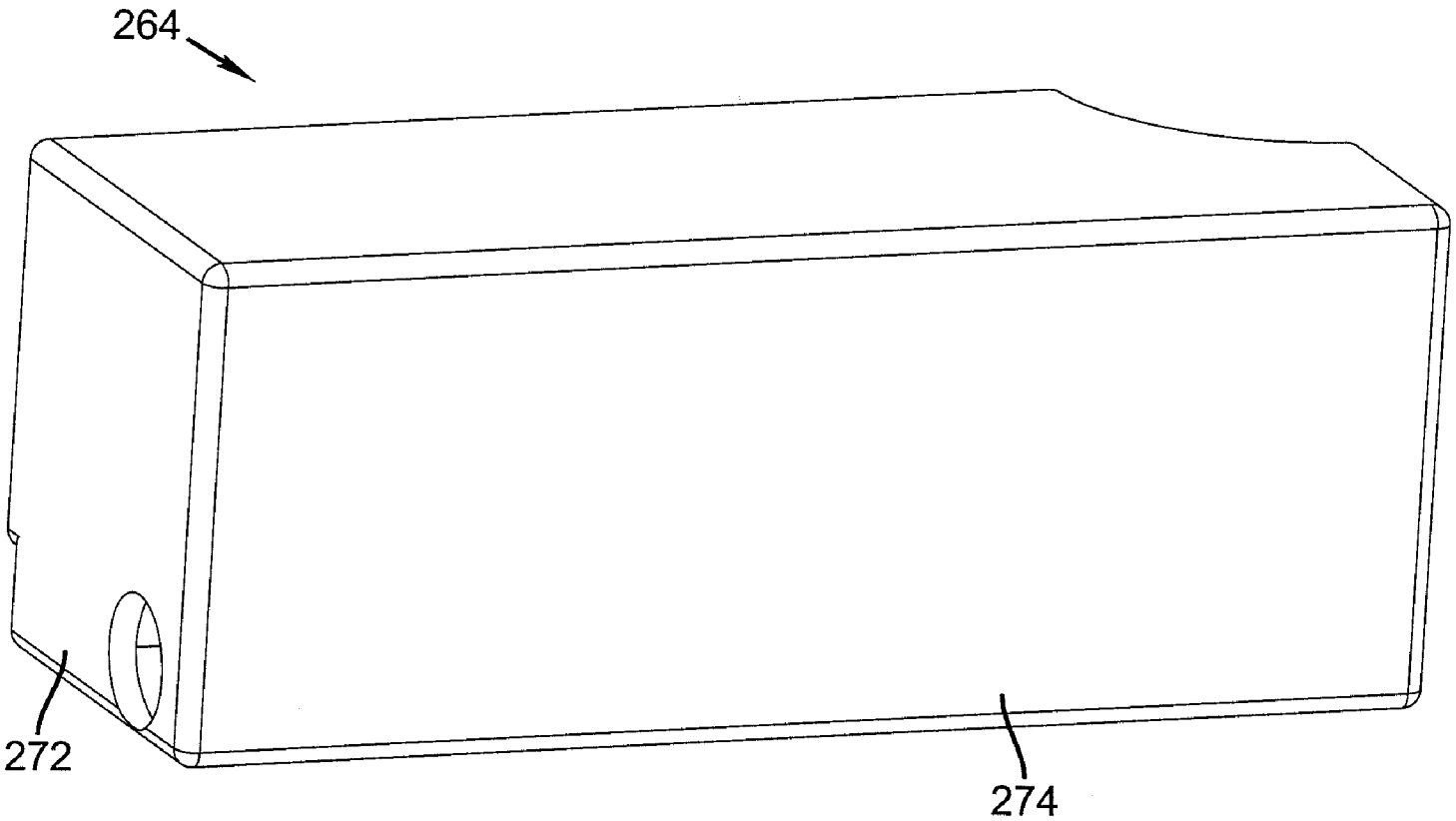
Figure 13:
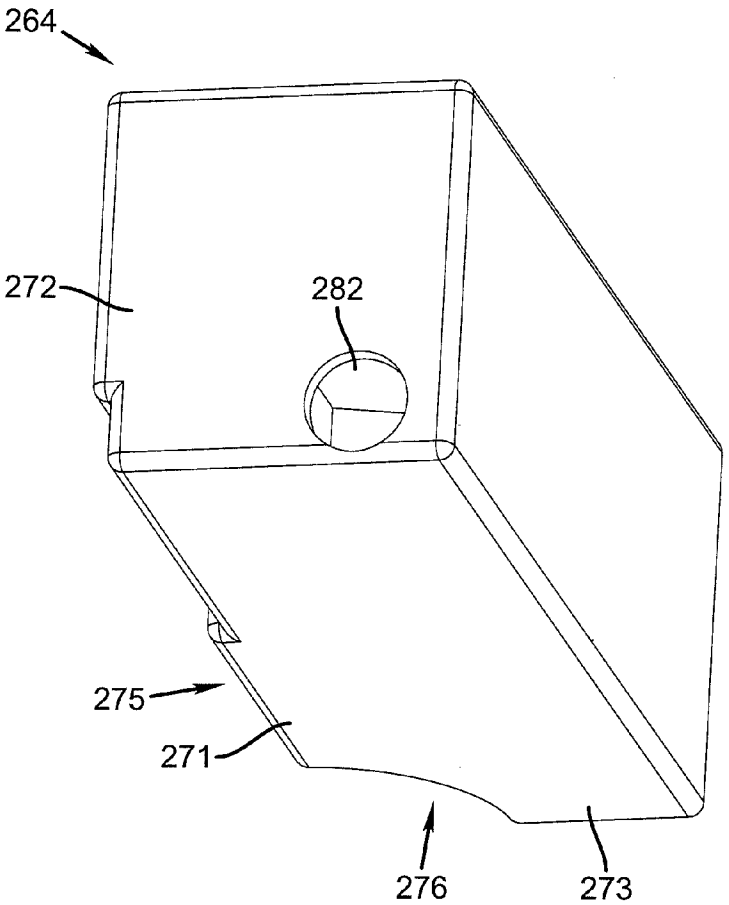
Figure 14:
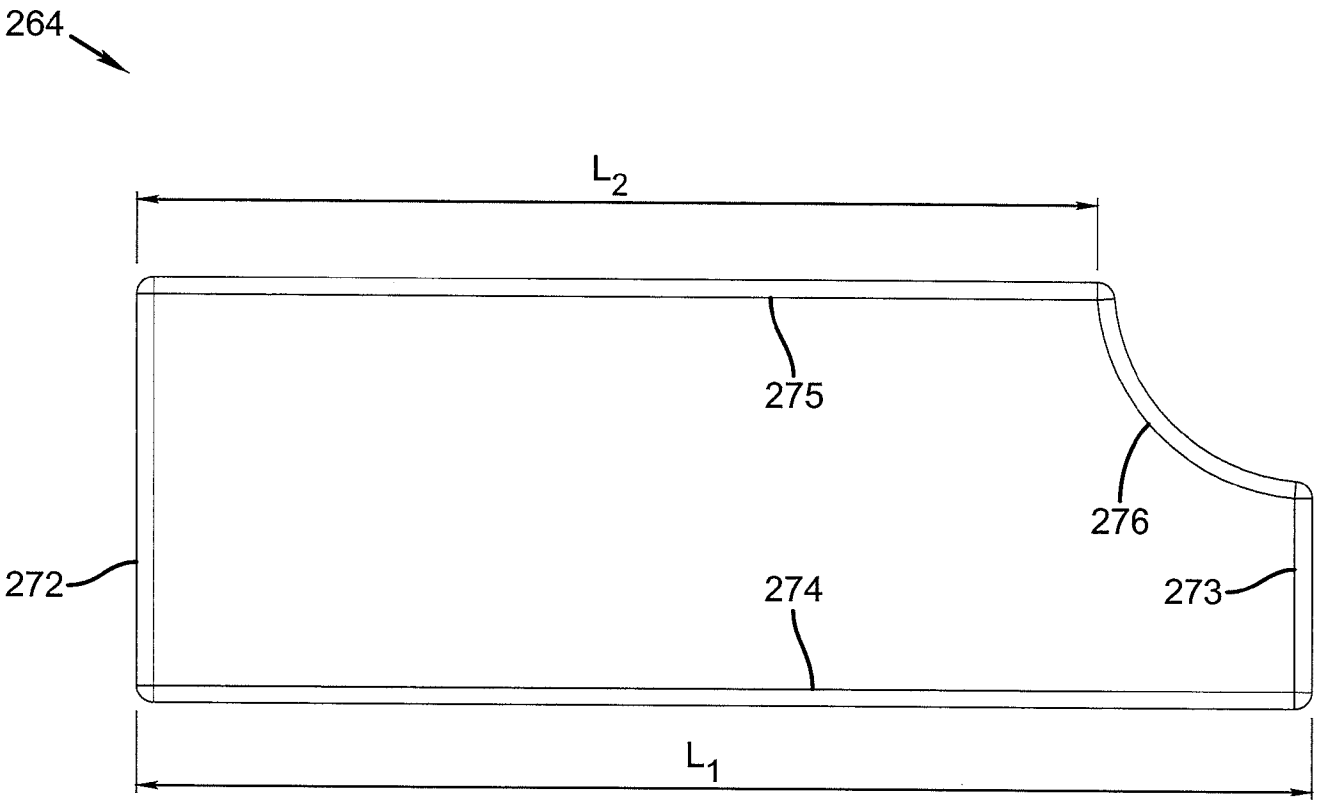
FIG. 14 is a top view of a single chamber ink tank according to an embodiment of the invention.
Figure 15:
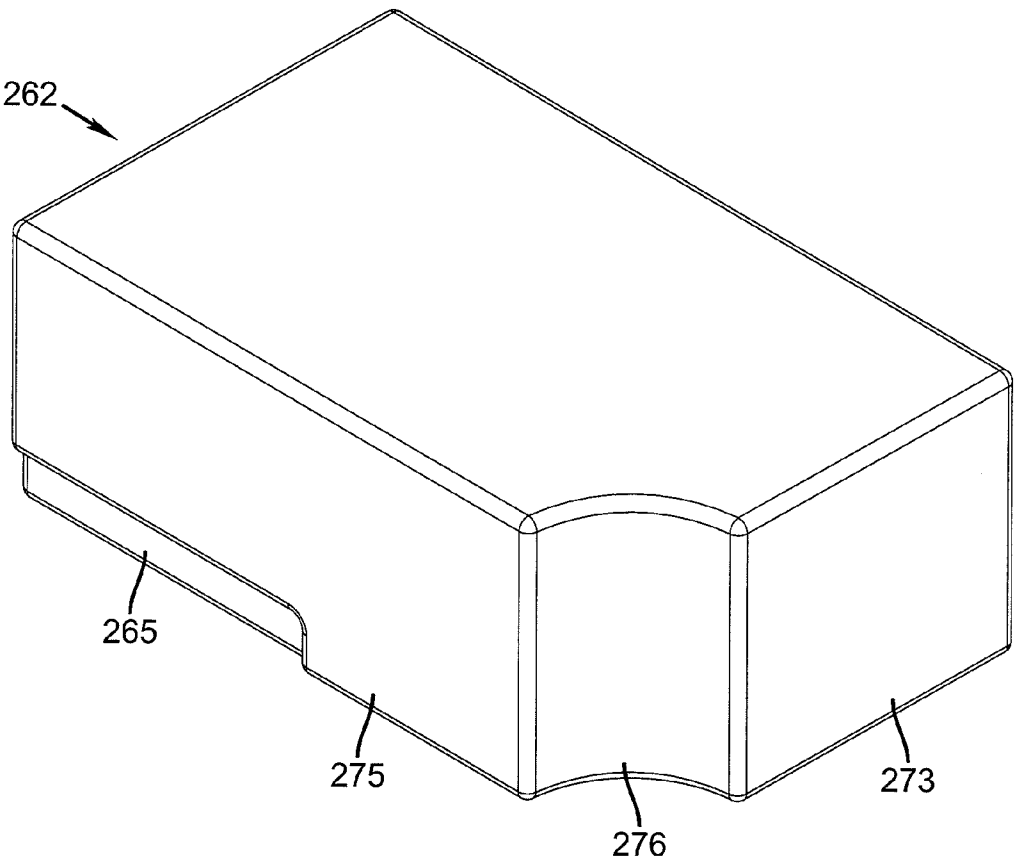
FIGS. 15-18 are perspective views of a multichamber ink tank according to an embodiment of the invention.
Figure 16:
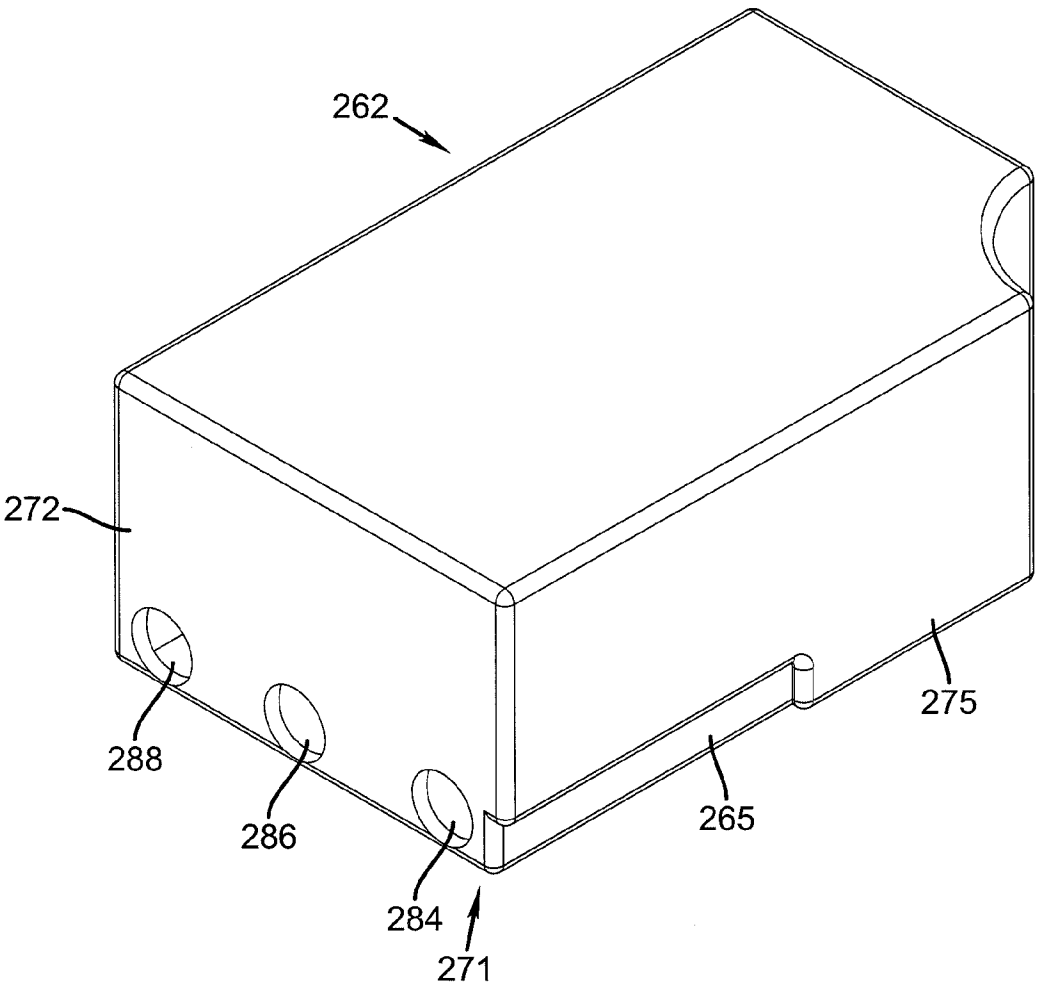
Figure 17:
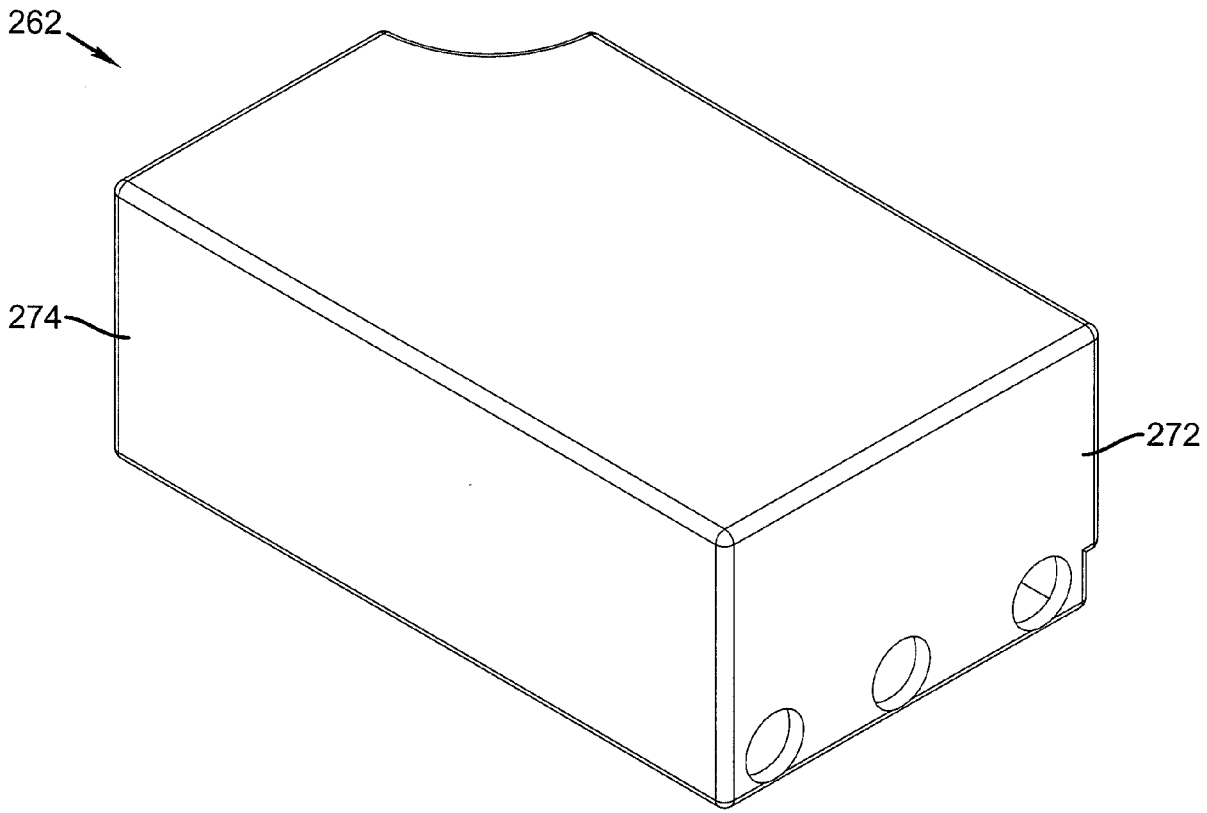
Figure 18:
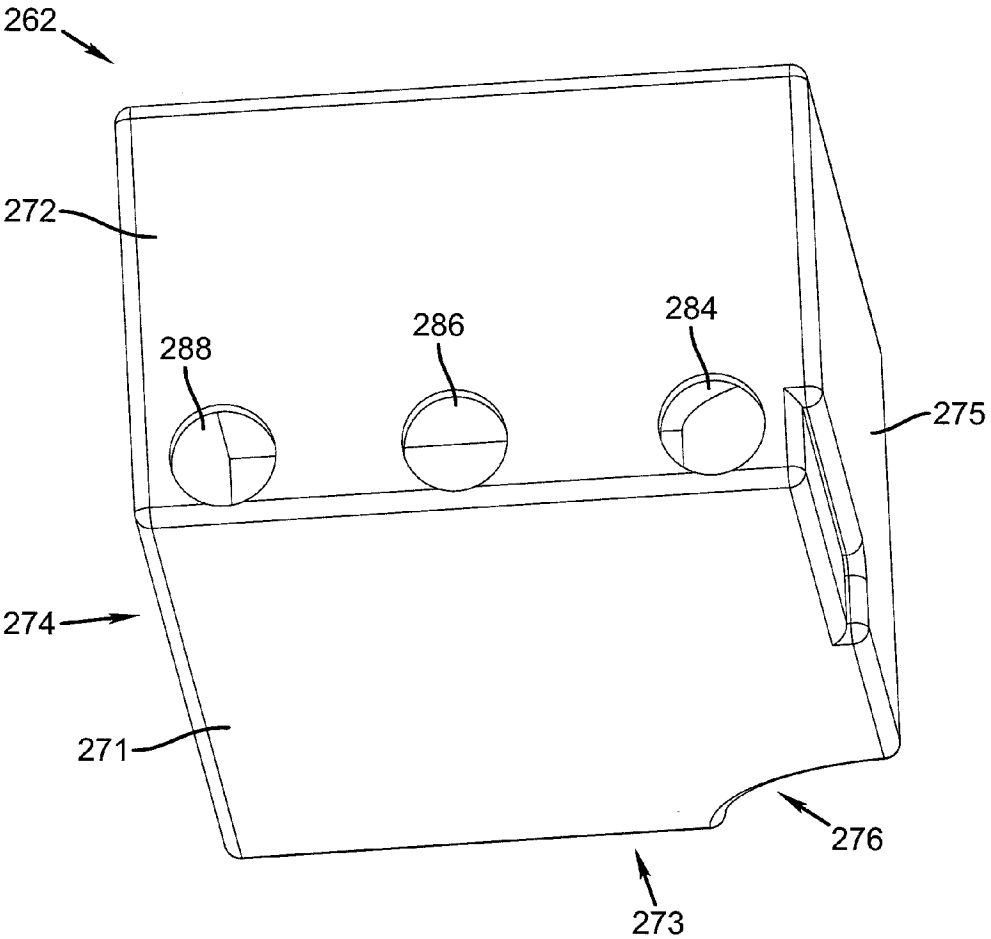
Figure 19:
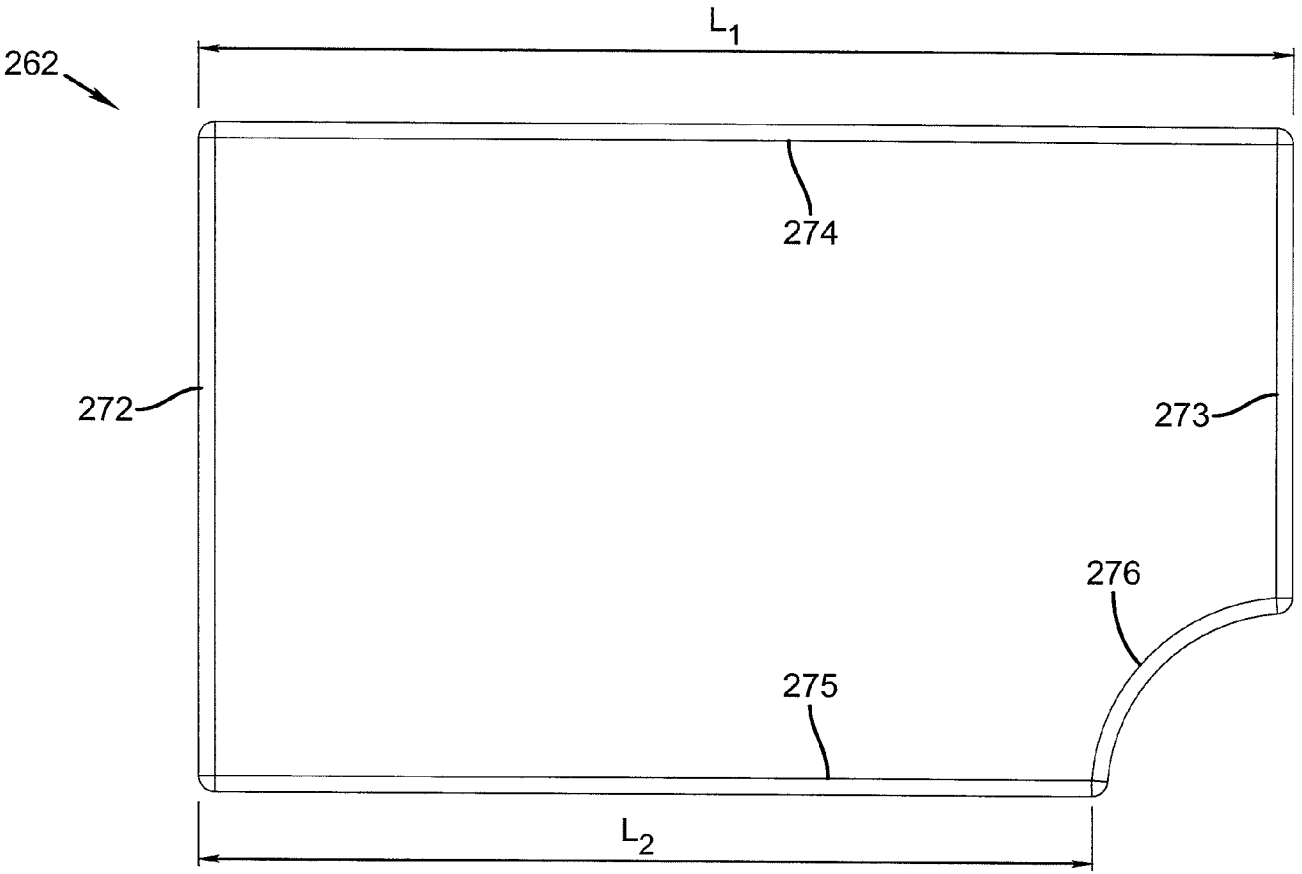
FIG. 19 is a top view of a multichamber ink tank according to an embodiment of the invention.

The overall appearance of single chamber ink tank 264 is shown in FIGS. 10-14, and the overall appearance of multichamber ink tank 262 is shown in FIGS. 15-19. FIGS. 10 and 15 are perspective views showing second end wall 273, second sidewall 275 with indented region 265, and connecting wall 276. FIGS. 11 and 16 are perspective views showing first end wall 272 with associated ink outlet port(s) and second sidewall 275 with indented region 265. Ink outlet port 282 of single chamber ink tank 264 engages with ink inlet port 222 of holding receptacle 210 (see FIGS. 3 and 7) when single chamber ink tank 264 is inserted into holding receptacle 210. Similarly, ink outlet ports 284, 286 and 288 engage with ink inlet ports 224, 226 and 228 when multichamber ink tank 262 is inserted into holding receptacle 210. Indented region 265 engages with partition 230 of holding receptacle 210 in order to guide the ink tanks into position during insertion. Ink outlet ports 282, 284, 286, and 288 are located near the bottom wall 271 of ink tanks 262 and 264 in order to facilitate extracting ink from the ink tanks. FIGS. 12 and 17 are perspective views showing first sidewall 274 and first end wall 272 plus associated ink outlet ports. FIGS. 13 and 18 are perspective views showing bottom wall 271 and a portion of the interior of ink tanks 264 and 262 respectively through ink outlet ports 282, 284, 286 and 288. Through ink outlet port 282 of single chamber ink tank 264 it is possible to see the joining of second sidewall 275, connecting wall 276 and a top wall that is opposite bottom wall 271. Through ink outlet port 284 of multichamber ink tank 262 it is possible to see the joining of second sidewall 275, connecting wall 276 and a top wall that is opposite bottom wall 271. Through ink outlet port 288 of multichamber ink tank 262 it is possible to see the joining of first sidewall 274, connecting wall 276 and a top wall that is opposite bottom wall 271. What is not visible in the view of FIG. 18 are the internal chamber walls that divide the interior of multichamber ink tank 262 into three ink chambers, each corresponding to a different one of ink outlet ports 284, 286 and 288. It is possible to provide equal volumes for ink storage within each of the three chambers by appropriately adjusting the spacing of the internal chamber walls to compensate for the recess at connecting wall 276 and the indented region 265. FIGS. 14 and 19 are top views that clearly show that the length $L_1$ of first sidewall 274 extending from first end wall 272 to second end wall 273 is longer than length $L_2$ of second sidewall 275 extending from first end wall 272. The curved or arcuate shape of connecting wall 276 forming a recess is also plainly seen in these figures.

Figure 20:
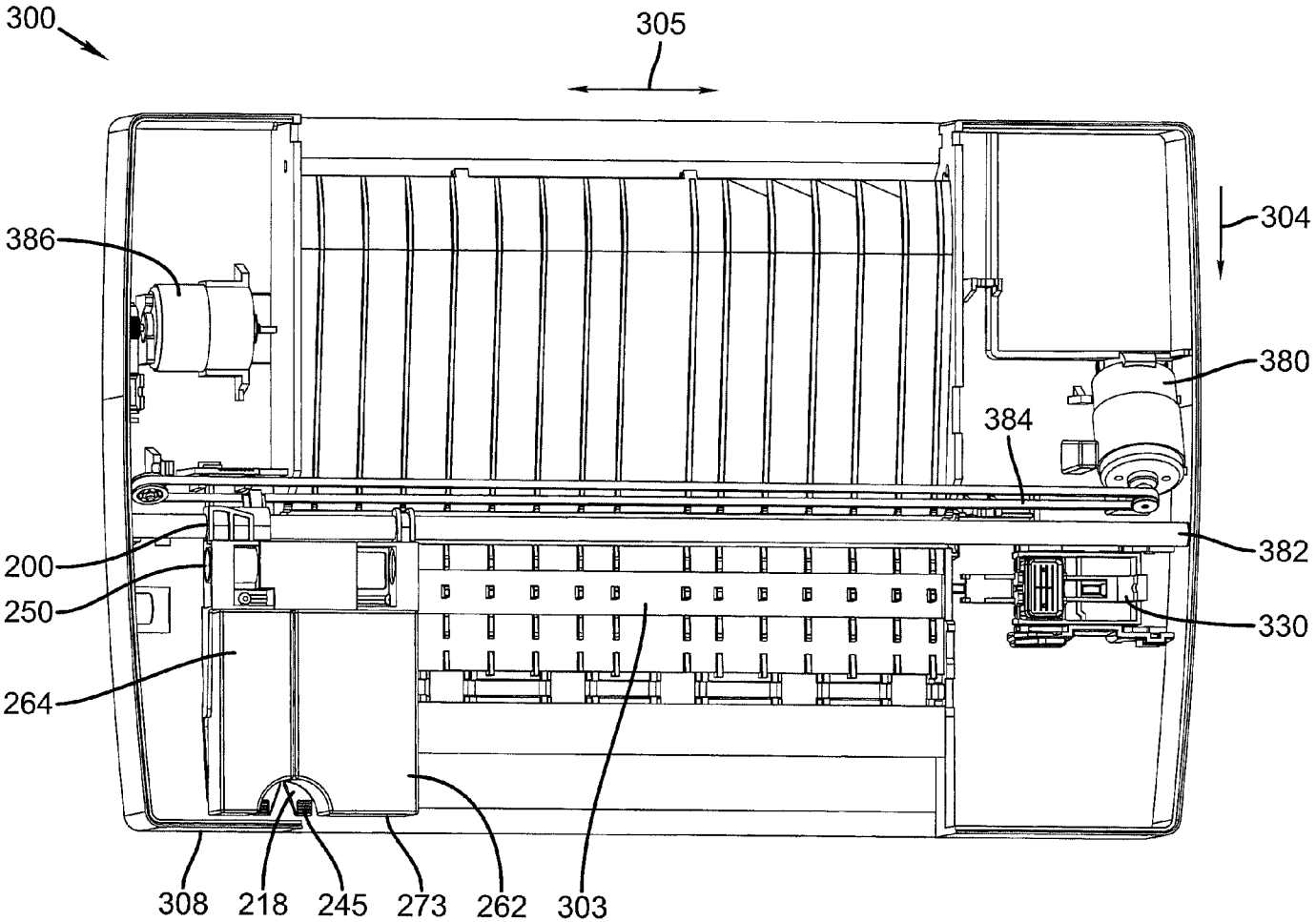
FIG. 20 is a top view of a portion of a carriage printer according to an embodiment of the invention.

FIG. 20 shows a top view of a desktop carriage printer 300 according to an embodiment of the present invention. Some of the parts of the printer have been hidden in the view shown in FIG. 20 so that other parts can be more clearly seen. Printer 300 has a print region 303 across which carriage 200 is moved back and forth in carriage guide direction 305, while drops are ejected from nozzle array 253 on printhead die 251 (not shown in FIG. 20) on printhead frame 250 that is mounted on carriage 200. In some embodiments, printhead frame 250 is integrally formed with carriage 200 as described above. Carriage motor 380 moves belt 384 to move carriage 200 along carriage guide 382.

Multichamber ink tank 262 and single chamber ink tank 264 are mounted in the holding receptacle of printhead frame 250. Latch 218 and its tip end 245 are labeled and shown in proximity to the second end wall 273 of multichamber ink tank 262. Printer 300 includes a base 309 on which the printer rests during operation (see FIGS. 21 and 22). A front wall 308 extends upward from base 309. To facilitate compact and low cost design of printer 300, tip end 245 of latch 218 and/or latch 219 is disposed less than 5 mm from an interior surface of the front wall 308 of printer 300. Because the second end walls 273 of single chamber ink tank 264 and multichamber ink tank 262 are very near tip ends 245 of their corresponding latches, this means that second end walls 273 are also located close to the interior surface of front wall 308. The mounting orientation of printhead frame 250 is rotated relative to the view in FIG. 2, so that the printhead die 251 are located at the bottom side of printhead frame 250, the droplets of ink being ejected downward onto the paper or other recording medium (not shown) in print region 303. Paper advance motor 386 is shown but the various rollers that move the paper along media advance direction 304 are not shown in FIG. 20. Maintenance station 330 is provided for wiping and capping the nozzle face.

Figure 21:
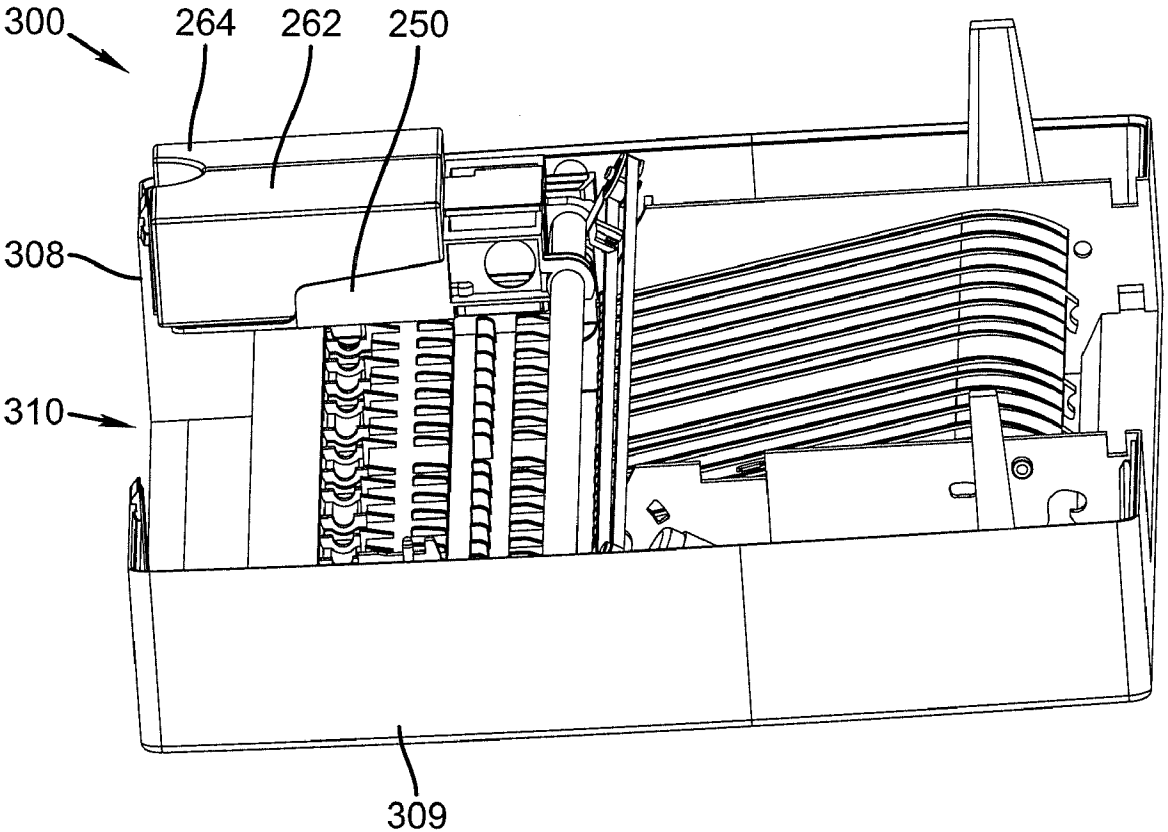
FIGS. 21 and 22 are perspective views of the carriage printer of FIG. 20.
Figure 22:
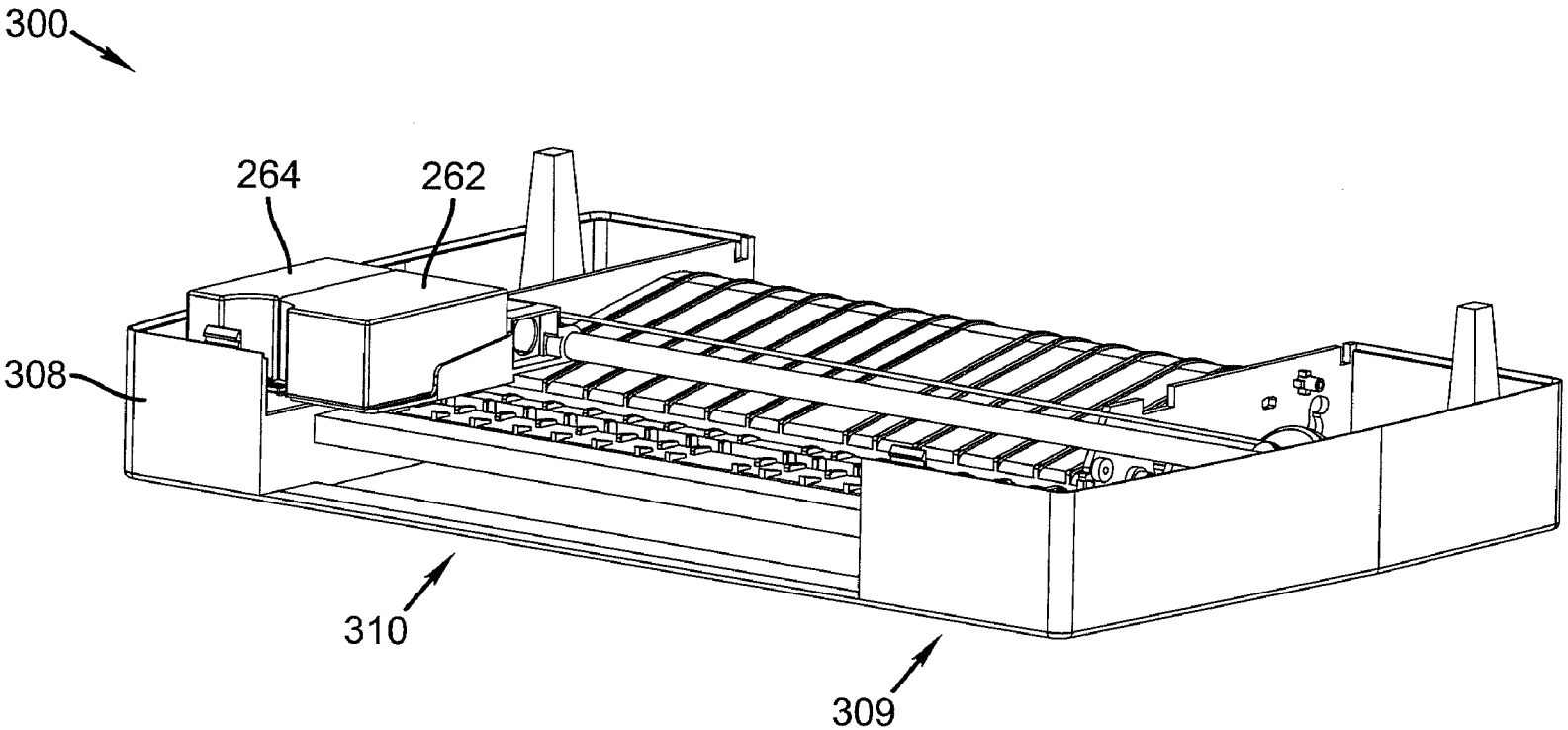

FIGS. 21 and 22 more clearly show front wall 308 of printer 300 and a doorway 310 through which the ink tanks 262 and 264 can be accessed for horizontal installation and removal. Printer 300 also includes a top surface (not shown), but the user can reach through doorway 310. Doorway 310 can consist of an opening as shown in FIGS. 21 and 22, or it can also optionally include a door (not shown) that the user can open in order to access the ink tanks 262 and 264. When an ink tank needs to be replaced, the carriage 200 is moved along carriage guide 382 until the ink tanks are located next to doorway 310. The user reaches through doorway 310 and releases the latch corresponding to the ink tank and grasps an end of the ink tank at the recessed connecting wall. The ink tank is then removed horizontally through the doorway 310. A replacement ink tank can then be inserted horizontally through doorway 310. The user can slide the replacement ink tank horizontally into the holding receptacle. After gently depressing the latching member as the ink tank is inserted into the holding receptacle, the latching member can be released so that it latches against the connecting wall 276 of the ink tank.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
202 Ink chamber
204 Ink chamber
206 Ink chamber
208 Ink chamber
210 Holding receptacle
211 First part (of holding receptacle)
212 Second part (of holding receptacle)
214 Base surface
215 First end
216 Second end
218 Latch
219 Latch
220 Wall
222 Ink inlet port
224 Ink inlet port
226 Ink inlet port
228 Ink inlet port
229 Pipe
230 Partition
232 First sidewall
234 Second sidewall
235 Free end
236 Cantilevered arm
237 Surface (of cantilevered arm)
238 Latching member
239 Latching surface
240 Pressing member
241 Pressing surface
242 Pressing direction
243 First portion (of latch)
244 Second portion (of latch)
245 Tip end
246 Insertion direction
248 Bearing surface
250 Printhead frame
251 Printhead die
253 Nozzle array
254 Nozzle array direction
262 Multi-chamber ink tank
264 Single-chamber ink tank
265 Indented region
270 Body (of ink tank)
271 Bottom wall (of ink tank)
272 First end wall (of ink tank)
273 Second end wall (of ink tank)
274 First sidewall (of ink tank)
275 Second sidewall (of ink tank)
276 Connecting wall (of ink tank)
282 Ink outlet port
284 Ink outlet port
286 Ink outlet port
288 Ink outlet port
300 Printer
303 Print region
304 Media advance direction
305 Carriage scan direction
308 Front wall (of printer)
309 Base (of printer)
310 Doorway
330 Maintenance station
380 Carriage motor
382 Carriage guide rail
384 Belt
386 Paper advance motor

The invention claimed is:

1. An inkjet printer comprising:
a carriage guide including a carriage guide direction;
an inkjet nozzle array that is movable back and forth along the carnage guide direction;
an ink tank for providing ink to the inkjet nozzle array; and
a holding receptacle for the ink tank, the holding receptacle comprising:
a planar base surface for supporting the ink tank, the base surface including a first end and a second end that is opposite the first end both of which are in the same plane as the base surface;
a latch including a latching member proximate the first end of the base surface for retaining the ink tank in the holding receptacle;
a cantilevered arm extending from the latch and having a surface that is coplanar or substantially coplanar with the base surface; and
a wall that includes an ink inlet port configured to receive ink from the ink tank, wherein the wall is proximate the second end of the base surface.

2. The inkjet printer as in claim 1, wherein the latch is a cantilevered latch extending from the base surface of the holding receptacle, and wherein the latch includes a free end that is proximate the first end of the base surface.

3. The inkjet printer as in claim 2, the inkjet nozzle array being a first inkjet nozzle array, the ink tank being a first ink tank, the cantilevered latch being a first cantilevered latch, and the ink inlet port being a first ink inlet port, wherein the inkjet printer further comprises:

a second inkjet nozzle array that is movable back and forth along the carriage guide direction;

a second ink tank for providing ink to the second inkjet nozzle array;

a second cantilevered latch extending from the base surface of the holding receptacle and including a latching member; and a second ink inlet port provided at the wall of the holding receptacle, the second ink inlet port being configured to receive ink from the second ink tank.

4. The inkjet printer as in claim 2, the cantilevered latch further including a cantilevered arm and a latching member, wherein the latching member is disposed proximate the free end and includes a latching surface.

5. The inkjet printer as in claim 4, wherein the latching surface of the latching member is substantially perpendicular to the base surface of the holding receptacle.

6. The inkjet printer as in claim 4, wherein a portion of the latching surface of the latching member is curved.

7. The inkjet printer as in claim 4, wherein the latching member further includes a pressing member that extends from the latching surface toward the free end of the cantilevered latch, and wherein the pressing member includes a pressing surface that is substantially parallel to the base surface of the holding receptacle.

8. The inkjet printer as in claim 1, wherein the latch is integrally formed with the base surface of the holding receptacle.

9. The inkjet printer as in claim 1, wherein the ink tank further comprises:

(i) a first end wall having an ink outlet port;

(ii) a second end wall opposite the first end wall;

(iii) a first sidewall that extends at a first length from the first end wall to the second end wall;

(iv) a second sidewall that extends a second length from the first end wall, wherein the second length is less than the first length; and (v) a connecting wall that forms a recess and connects the second end wall to the second sidewall.

10. The inkjet printer as in claim 9, the latching member of the holding receptacle including a latching surface and a tip end, wherein the tip end of the latching member does not extend past the second end wall of the ink tank when the latching surface engages the connecting wall of the ink tank.

11. The inkjet printer as in claim 9, the latching member of the holding receptacle including a latching surface and a tip end, wherein the tip end of the latching member extends past the second end wall of the ink tank by less than 3 mm when the latching surface engages the connecting wall of the ink tank.

12. The inkjet printer as in claim 1, wherein the holding receptacle further comprises at least one bearing surface configured to ride on the carriage guide.

13. An inkjet printer comprising:

a carriage guide including a carriage guide direction;

an inkjet nozzle array that is movable back and forth along the carriage guide direction;

an ink tank for providing ink to the inkjet nozzle array; and a holding receptacle for the ink tank, the holding receptacle comprising:

a base surface for supporting the ink tank, the base surface including a first end and a second end that is opposite the first end;

a latch including a latching member proximate the first end of the base surface for retaining the ink tank in the holding receptacle;

a cantilevered arm extending from the latch and having a surface that is coplanar or substantially coplanar with the base surface; and a wall that includes an ink inlet port configured to receive ink from the ink tank, wherein the wall is proximate the second end of the base surface;

a base that the printer rests on during operation; and a front wall extending upwardly from the base, wherein the front wall includes a doorway for accessing the ink tank.

14. The inkjet printer as in claim 13, wherein a tip end of the latching member is disposed less than 5 mm from an interior surface of the front wall.

15. An inkjet printer comprising:

a carriage guide including a carriage guide direction;

an inkjet nozzle array that is movable back and forth along the carriage guide direction;

an ink tank for providing ink to the inkjet nozzle array; and a holding receptacle for the ink tank, the holding receptacle comprising:

a base surface for supporting the ink tank, the base surface including a first end and a second end that is opposite the first end;

a latch including a latching member proximate the first end of the base surface for retaining the ink tank in the holding receptacle; and a wall that includes an ink inlet port configured to receive ink from the ink tank, wherein the wall is proximate the second end of the base surface; wherein the latch is a cantilevered latch extending from the base surface of the holding receptacle, and wherein the latch includes a free end that is proximate the first end of the base surface;

wherein the cantilevered latch further includes a cantilevered arm and a latching member, wherein the latching member is disposed proximate the free end and includes a latching surface; wherein the latching member further includes a pressing member that extends from the latching surface toward the free end of the cantilevered latch, and wherein the pressing member includes a pressing surface that is substantially parallel to the base surface of the holding receptacle;

wherein the pressing surface is normally disposed at a first position above the base surface of the holding receptacle, and wherein the pressing member of the cantilevered latch can be depressed so that the pressing surface is disposed at a second position below the base surface of the holding receptacle.

16. An inkjet printer comprising:

a carriage guide including a carriage guide direction;

an inkjet nozzle array that is movable back and forth along the carriage guide direction;

an ink tank for providing ink to the inkjet nozzle array; and a holding receptacle for the ink tank, the holding receptacle comprising:

a base surface for supporting the ink tank, the base surface including a first end and a second end that is opposite the first end;

a latch including a latching member proximate the first end of the base surface for retaining the ink tank in the holding receptacle; and a wall that includes an ink inlet port configured to receive ink from the ink tank, wherein the wall is proximate the second end of the base surface; wherein the latch is a cantilevered latch extending from the base surface of the holding receptacle, and wherein the latch includes a free end that is proximate the first end of the base surface;

wherein the first ink tank comprises:

a first end wall including an ink outlet port;

a second end wall opposite the first end wall; and a connecting wall that is configured to engage the latching member of the first cantilevered latch;

and wherein the second ink tank comprises:

a first end wall including an ink outlet port; and a second end wall opposite the first end wall; and a connecting wall that is configured to engage the latching member of the second cantilevered latch.

17. The inkjet printer as in claim 16, wherein the connecting wall of the first ink tank is adjacent the connecting wall of the second ink tank when the latching member of the first cantilevered latch engages the connecting wall of the first ink tank, and the latching member of the second cantilevered latch engages the connecting wall of the second ink tank.

18. The inkjet printer as in claim 17, wherein the connecting wall of the first ink tank is recessed relative to the second end wall of the first ink tank, and wherein the connecting wall of the second ink tank is recessed relative to the second end wall of the second ink tank, thereby providing a recessed region for accessing the latching members of the first and second cantilevered latches with a finger or thumb.

19. The inkjet printer as in claim 18, wherein the latching member of the first cantilevered latch angles away from the latching member of the second cantilevered latch, such that a tip end of the latching member of the first cantilevered latch is at least 3 mm away from an adjacent tip end of the latching member of the second cantilevered latch.

20. The inkjet printer as in claim 19, wherein the latching member of the first cantilevered latch and the latching member of the second cantilevered latch are independently depressible when the first and second ink tanks are installed, so that the first and second ink tank can be independently unlatched from the holding receptacle.

21. A method for replacing a first ink tank with a replacement ink tank in an inkjet printer having a vertical or substantially vertical doorway in a front wall, the method comprising the steps of:

providing a latch that is released by using a finger and/or thumb;

grasping an end of the first ink tank at a recess;

removing the first ink tank horizontally through the doorway in the vertical or substantially vertical front wall;

inserting the replacement ink tank horizontally through the doorway;

sliding the replacement ink tank into the holding receptacle while holding down the latching member; and releasing the latching member.

* * * * *